US007766473B2

(12) United States Patent
Hoshino

(10) Patent No.: US 7,766,473 B2
(45) Date of Patent: Aug. 3, 2010

(54) INKJET RECORDING DEVICE AND INKJET RECORDING

(75) Inventor: Yoshihide Hoshino, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 523 days.

(21) Appl. No.: 11/816,367

(22) PCT Filed: Feb. 8, 2006

(86) PCT No.: PCT/JP2006/302129

§ 371 (c)(1),
(2), (4) Date: Aug. 15, 2007

(87) PCT Pub. No.: WO2006/087949

PCT Pub. Date: Aug. 24, 2006

(65) Prior Publication Data

US 2008/0192101 A1 Aug. 14, 2008

(30) Foreign Application Priority Data

Feb. 18, 2005 (JP) ..... 2005-042223

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS 6,866,376 B2 * 3/2005 Maeda et al. ..... 347/102
2003/0011670 A1 1/2003 Shirakawa

FOREIGN PATENT DOCUMENTS

| | | |
|---|---|---|
| GB | 2 399 162 A | 9/2004 |
| JP | 2004-167864 | 6/2004 |
| JP | 2004-237588 | 8/2004 |

OTHER PUBLICATIONS

European Search Report dated Apr. 3, 2009.

* cited by examiner

*Primary Examiner*—Julian D Huffman
(74) *Attorney, Agent, or Firm*—Finnegan, Henderson, Farabow, Garrett & Dunner, L.L.P.

(57) ABSTRACT

An inkjet recording apparatus including: a recording head having a plurality of ink ejection openings for ejecting photocurable ink, the ink ejection openings being formed along a feeding direction of the recording medium; a light irradiation device for irradiating the ejected ink; a moving unit for reciprocally moving the recording head and the light irradiation device in a main scanning direction; a feeding unit for feeding the recording medium in the feeding direction by a predetermined amount at a time; and a control unit for ejecting ink needed for forming one band by reciprocally scanning the recording head n times to record an image, wherein the inkjet recording apparatus irradiates the ink ejected in respective scans of first to (n−1)th scans with the light at the respective scans and the inkjet recording apparatus irradiates the ink ejected in the nth scan at one of the (n+1)th and subsequent scans.

9 Claims, 5 Drawing Sheets

INKJET RECORDING DEVICE AND INKJET RECORDING

TECHNICAL FIELD

The present invention relates to inkjet recording methods and devices, and more particularly relates to inkjet recording methods and devices employing a serial printing system.

BACKGROUND ART

Conventionally, recording devices of an inkjet system (henceforth referred to as "inkjet recording device") are widely known as an inkjet recording device which can flexibly adapt to high mix, low volume demands. Inkjet recording devices record an image on a recording medium by ejecting ink from a nozzle provided at a surface of a recording head facing the medium and causing it to land on the medium to fix it thereto, and are characterized in that they need no plate making process unlike conventional image recording means such as photogravure or flexographic printing, thus being capable of simply and quickly adapting to low volume demands. They also have advantages of generating less noise and easily providing color image recording by using ink of multicolors.

In recent years, inkjet recording devices using a photo curable ink have become known as an inkjet recording device capable of adapting to various recording media (e.g., Patent Document 1). In such inkjet recording devices, a photo curable ink containing a photo initiator having a certain sensitivity to light such as ultraviolet light is ejected and lands on a recording medium, which is then irradiated with light to be cured and fixed to the medium. In such inkjet recording devices, ink cures by irradiation with light instantaneously after the landing of the ink; so they have less penetration and bleeding of ink into a recording medium and can record an image not only on plain papers but also on recording media having no ink receiving layer and therefore having no ink absorptivity such as plastic or metal.

One of such inkjet recording devices is an inkjet recording device 50 of a serial printing system as shown in FIG. 9, in which a recording head 51 is reciprocally scanned in a main scanning direction while a recording medium is being intermittently fed in a feeding direction to form an image. In such an inkjet recording device 50, an photo curable ink is ejected from the recording head 51 and lands on the recording medium, and then irradiated with light by a light irradiation device 52 to be cured, and such a scan is repeated multiple times to form an image.

However, in conventional inkjet recording devices 50, the moving direction in the main scanning direction of the recording head 51 and light irradiation device 52 is switched without changing their relative position, so that the interval of time after the landing of ink until the irradiation with light differs between in the forward and backward scanning directions of the recording head 51. That is, the time needed for curing the ink is different between in the forward and backward scanning directions of the recording head 51, resulting in difference in dot diameter and degree of dot joining, which in turn presents a problem because the hue or gloss of the recorded image differs between the main scanning directions.

In order to avoid the difference in the hue or gloss of a recorded image between the main scanning directions, a technique is conventionally known in which two recording heads for ejecting ink of multiple colors are symmetrically disposed in the main scanning direction, thereby preventing difference in ink overlap between the forward and backward main scanning directions (e.g., Patent Document 2).

Also known is a technique of adjusting the amount of ink ejection in an inkjet recording device which records an image using an aqueous ink (e.g., Patent Document 3).

Patent Document 1: Japanese Unexamined Patent Application Publication No. 2001-310454.

Patent Document 2: Japanese Patent No 3248704.

Patent Document 3: Japanese Unexamined Patent Application Publication No. 2003-25613.

DISCLOSURE OF INVENTION

Technical Problem

However, the technique described in the above-mentioned Patent Document 2 requires twice as many recording heads compared to conventional techniques, thus requiring a larger and heavier device.

The technique described in the above-mentioned Patent Document 3 uses an aqueous ink penetrable into a recording medium and adjusts the amount of ink ejection based on the degree of ink penetration; therefore it cannot be applied to photo curable inks which hardly penetrate into a recording medium and whose dot diameter and degree of dot joining depend on the difference in timing at which ink is cured by light irradiation, the intensity of light irradiation, and others.

It is an object of the invention, which was made in view of the above problems, to provide an inkjet recording method and device which prevents difference in the hue or gloss of each band along the main scanning direction, thereby enabling high resolution image recording.

Technical Solution

In order to solve the foregoing problems, one aspect of the present invention provides an inkjet recording apparatus including: a recording head having an ink ejection opening for ejecting a photo-curable ink cured by irradiation with light onto a recording medium, the ink ejection opening being formed along a feeding direction of the recording medium; a light irradiation device including a light source for irradiating the ejected ink with light; moving unit for reciprocally moving the recording head and light irradiation device in a main scanning direction; feeding unit for intermittently feeding the recording medium in the feeding direction by a predetermined amount at a time; and a control for ejecting ink needed for forming one band by reciprocally scanning the recording head n times to record an image, in which each irradiation of the ink ejected at the first to (n−1)th scans is performed at the respective scan while the irradiation of the ink ejected at the nth scan is performed at the (n+1)th and subsequent scans.

Further, an inkjet recording method according to one aspect of the invention includes the steps of: ejecting a photo-curable ink cured by irradiation with light onto a recording medium from a recording head while reciprocally scanning the recording head in a main scanning direction; and recording an image by irradiating the ejected ink with light, in which, when ejecting ink needed for forming one band by reciprocally scanning the recording head n times, each irradiation of the ink ejected at the first to (n−1)th scans is performed at the respective scan while the irradiation of the ink ejected at the nth scan is performed at the (n+1)th and subsequent scans.

In the above-mentioned configuration and method according to the invention, a photo-curable ink cured by irradiation with light is ejected onto the recording medium from the recording head while the recording head is being reciprocally scanned in the main scanning direction, and then an image is recorded by irradiating the ejected ink with light. Here, the ink needed for forming one band is ejected by reciprocally scanning the recording head n times, and the ink ejected at the first to (n−1)th scans is each irradiated with light at the respective scan while the ink ejected at the nth scan is irradiated with light not at the nth scan but at the (n+1)th and subsequent scans.

Advantageous Effect

According to the above-mentioned configuration and method of the invention, the ink ejected at the nth scan, which is the last scan for each band, is irradiated with light at a timing corresponding to the (n+1)th and subsequent scans; thus, sufficient time has elapsed after the ink ejected at the nth scan has landed on the recording medium until it is irradiated with light. As a result, the diameter of dots has sufficiently expanded and become uniform irrespective of the scan direction before they are irradiated with light, which prevents difference in hue or gloss caused by dot diameter difference between scans, thus offering high-resolution image recording.

In general, a diameter difference between dots ejected at the last scan for recording each band has the most significant effect on the quality of the recorded image when observed with bare eyes. The invention secures sufficient time after the ink ejected at the nth scan has landed on the recording medium until it is irradiated with light, so that the ink is irradiated with light and cured after the diameter of the dots has become uniform irrespective of the scanning direction. Therefore, degradation of image quality caused by dot diameter difference can be prevented, thus ensuring high-resolution image recording.

LEGENDS

Figure 1:
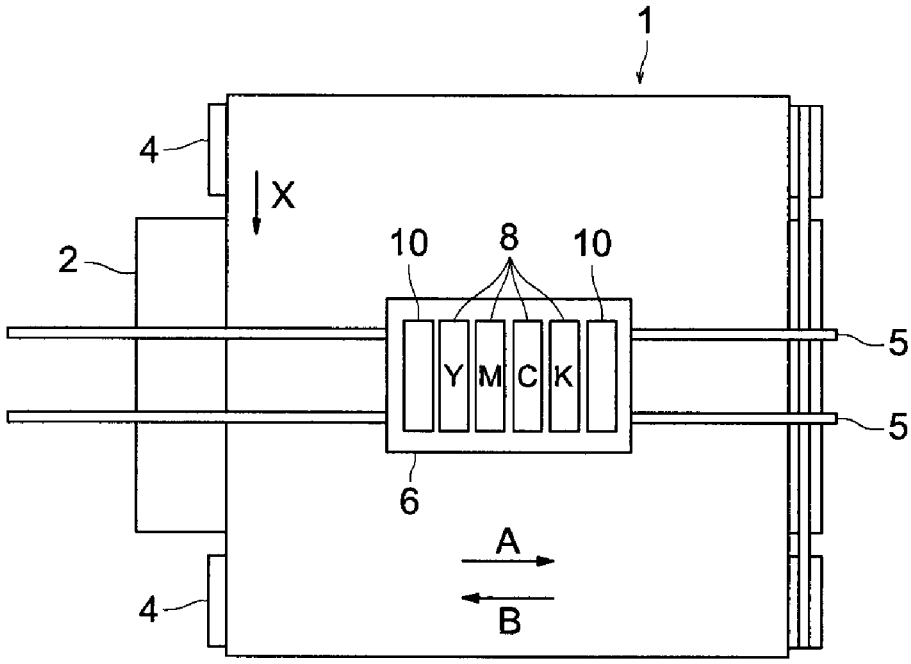
FIG. 1 is a top view illustrating a configuration of a principal part of an inkjet recording apparatus according to an embodiment of the present invention.

1 inkjet recording apparatus
3 feeding unit
6 carriage
7 moving unit
8 recording head
9 ink ejection opening
10, 21 ultraviolet irradiation device
12 ultraviolet light source
13 shield
14 shield adjustment mechanism
15 reflector
16 control
17 input
20 light source unit
A forward direction
B backward direction
P recording medium
X feeding direction

BEST MODE FOR CARRYING OUT THE INVENTION

Embodiments of an inkjet recording method and apparatus according to the present invention will be described below with reference to the accompanying drawings. However, the scope of the invention is not limited to the illustrated examples.

As shown in FIG. 1, an inkjet recording apparatus 1 according to this embodiment is of a serial printing system and provided with a platen 2 for supporting a recording medium P formed in a plate-like shape from the unrecorded surface.

Below the platen 2 is provided feeding unit 3 (see FIG. 5) for feeding the recording medium P in a feeding direction X perpendicular to main scanning directions A, B. The feeding unit 3 is configured with feed rollers 4, 4 and others such that rotation of the feed rollers 4 allows the recording medium P to be intermittently fed from the upstream side to the downstream side in the feeding direction X.

Figure 2:
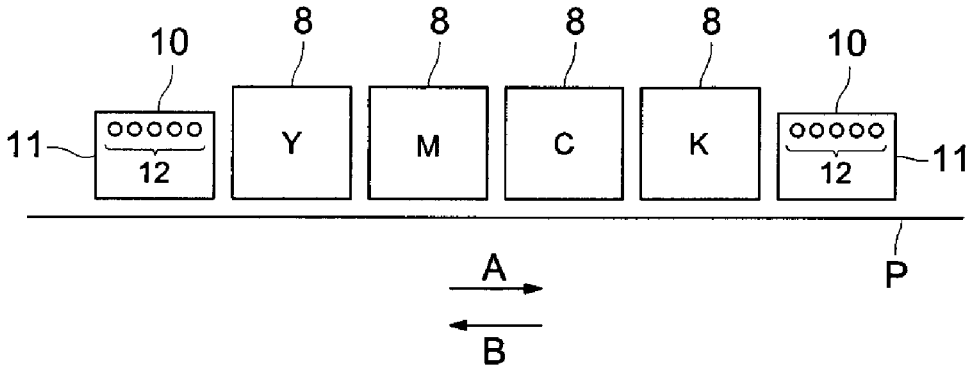
FIG. 2 is a side view of a carriage according to an embodiment of the present invention.

Above the platen 2 is provided rod-like guide rails 5, 5 extending in the longitudinal direction of the platen 2. A carriage 6 is supported on the guide rails 5 as shown in FIG. 2. Moving unit 7 (see FIG. 5) is connected to the carriage 6 so that it is free to be reciprocally scanned in the forward main scanning direction A and backward main scanning direction B along the guide rails 5.

On the carriage 6 is mounted four recording heads 8 each corresponding to a respective one of colors (black (K), cyan (C), magenta (M), yellow (Y)) used in the inkjet recording apparatus 1 of the embodiment. The recording heads 8 are each formed in the outer shape of an approximately rectangular solid and disposed with their longitudinal directions being parallel to each other along the feeding direction X. Multiple ink ejection openings 9 (see FIG. 3) are equally spaced along the feeding direction X on the surface of the recording head 8 facing the recording medium P. The ink ejection openings 9 of the recording head 8 are so disposed that the length of the column of all the ink ejection openings 9 in the feeding direction X is equal to L.

The ink ejection openings 9 of the recording head 8 each eject an ink drop of the respective color based on inputted image information. The ink colors used in the inkjet recording apparatus 1 are not limited to the above-mentioned ones, but may be other colors such as light yellow (LY), light magenta (LM), or light cyan (LC). In this case, recording heads each corresponding to the respective color will be mounted on the carriage.

Figure 3:
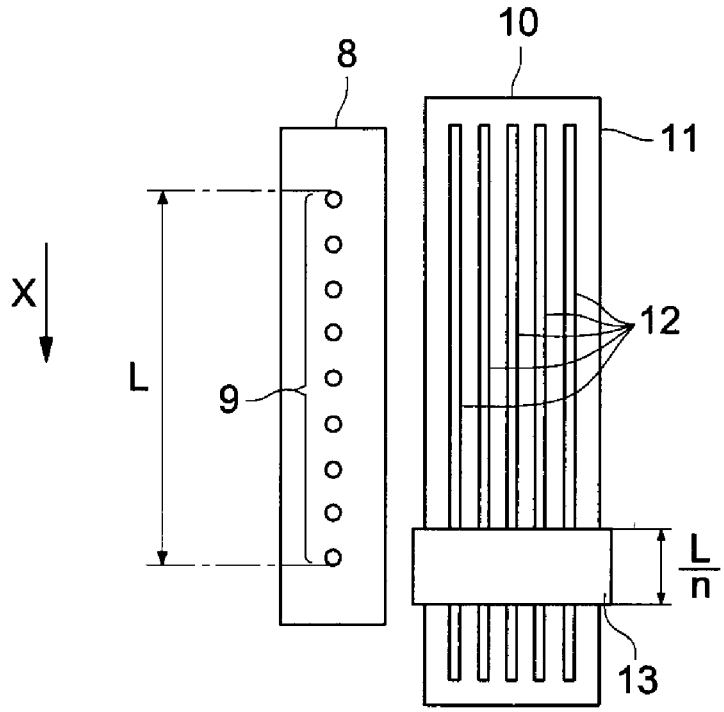
FIG. 3 is a bottom view of a recording head and ultraviolet irradiation device according to an embodiment of the present invention.

As shown in FIG. 2, ultraviolet irradiation devices 10, 10 serving as a light irradiation device are each disposed on the respective side of the recording heads 8 in the main scanning directions A, B. Here, FIG. 3 illustrates a bottom view of the recording heads 8 and ultraviolet irradiation device 10.

The ultraviolet irradiation device 10 is covered with a cover 11 of an approximately rectangular solid outer shape having an opening facing the recording medium P. As the ultraviolet irradiation device 10 is covered with the cover 11, it efficiently emits ultraviolet light toward the recording medium P. Inside the cover 11 is equipped with multiple ultraviolet light sources 12 serving as light for curing and fixing the ink drop ejected to the recording medium P. Each ultraviolet light source 12 is a rod-like fluorescent tube and disposed parallel to the feeding direction. The length of the ultraviolet light source 12 along the feeding direction is expressed as $L\times(1+1/n)$. Here, n represents the number of ink ejection scans needed for forming one band by the inkjet recording apparatus 1 of the embodiment.

As the ultraviolet light source 12, any suitable rod-shaped light source may be used as an alternative such as high-pressure mercury lamps, low-pressure mercury lamps, metal halide lamps, cold-cathode tubes or excimer lamps. The number of the ultraviolet light sources 12 may be at least one for each ultraviolet irradiation device 10, and the intensity of ultraviolet light irradiation can be adjusted by the type and number of the ultraviolet light sources 12 used.

A shield 13 for screening out at least light of ultraviolet wavelengths is provided at the bottom end of the ultraviolet irradiation device 10 in a portion facing the ink ejected at the nth scan. The shield 13 has an approximately flat plate outer shape, and formed to have a length approximately equal to that of the cover 11 along the main scanning directions A, B. In addition, the length along the feeding direction X is adjusted to be always equal to L/n by a shield adjustment mechanism 14 (see FIG. 5) based on any change of the number of scans n. There is no particular limitation to the shield adjustment mechanism 14. One example of such is a mechanism which is configured with a pair of rods for rolling and unrolling the shield 13 and a rotary driver for rotating the rods. Such shield adjustment mechanism 14 rotates the rods by the rotary driver to adjust the length along the feeding direction X of the shield 13. Although, in this embodiment, the length along the feeding direction X of the shield 13 is adjusted by electrical signal, it may be manually adjusted with an operator's hand.

Figure 4:
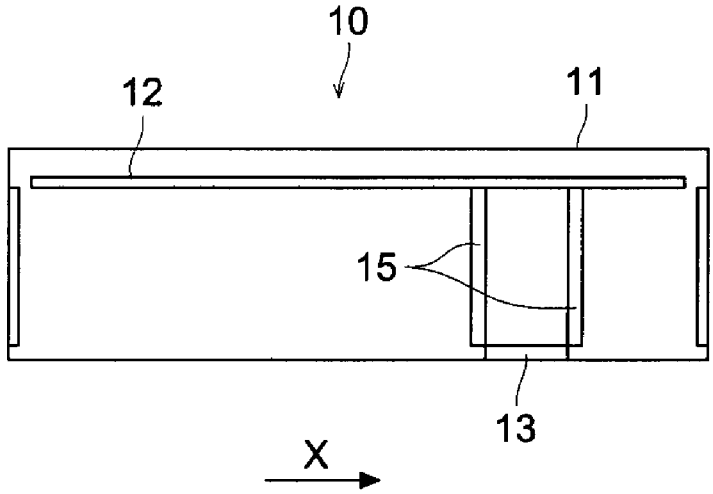
FIG. 4 is a sectional view of an ultraviolet irradiation device according to an embodiment of the present invention.

FIG. 4 is a sectional view of the ultraviolet irradiation device 10 along the feeding direction X. At the front and rear ends of the shield 13 in the feeding direction X are provided reflectors 15 for reflecting at least light of ultraviolet wavelengths such that the reflectors do not face each other and are approximately perpendicular to the recording medium P.

The shield 13 may be a filter or the like which screens out the corresponding wavelength range of the ultraviolet light source 12. Although, in this embodiment, ultraviolet light incident on the ink ejected at the nth scan is completely shielded by the reflector 15 and others, the present invention can provide an adequate effect by securing sufficiently long time for curing the ink ejected at the nth scan even if ultraviolet light is not completely shielded.

The ink used in this embodiment is a photo curable ink having a property of being cured by irradiation with ultraviolet light and containing at least a polymerizable compound (including known polymerizable compounds), photoinitiator and colorant as the main components. The above-mentioned photo curable inks are broadly divided into: radical polymerizable inks containing a radical polymerizable compound as the polymerizable compound; and cationic polymerizable inks containing a cationic polymerizable compound as the polymerizable compound. Both of these inks can be used as the ink for this embodiment. A hybrid ink prepared by mixing a radical polymerizable ink and a cationic polymerizable ink may also be used as the ink for this embodiment. However, a cationic polymerizable ink is particularly preferable because it has less or no polymerization inhibiting effect of oxygen and thus is more excellent in functionality and versatility. A cationic polymerizable ink is a compound containing at least: a cationic polymerizable compound such as an oxetane compound, epoxy compound or vinyl ether compound; a cationic photoinitiator; and a colorant.

The recording medium P usable in this embodiment includes: various types of papers such as plain papers, recycled papers, or glossy papers; various types of textiles; various types of non-woven fabrics; and the recording medium P of various materials such as resins, metals or glasses. The recording medium P can take various forms such as a roll-like, cut sheet or plate-like form.

A control configuration of the inkjet recording apparatus 1 according to this embodiment will now be described with reference to FIG. 5.

Figure 5:
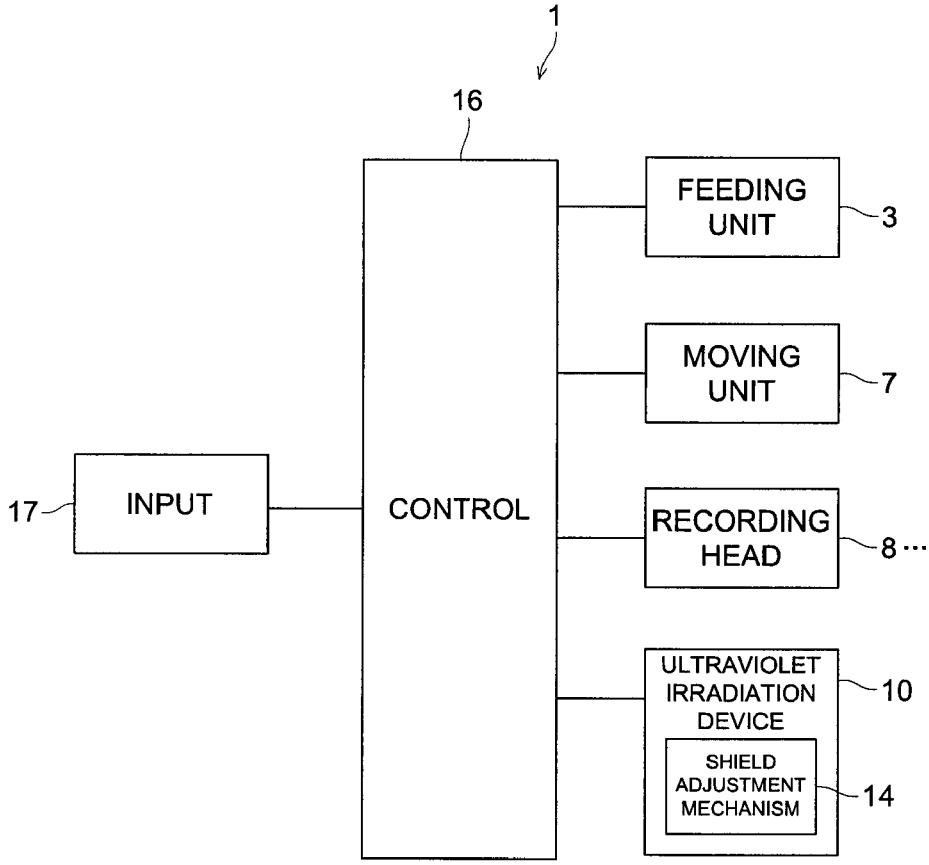
FIG. 5 is a block diagram illustrating a control configuration of an inkjet recording apparatus according to an embodiment of the present invention.
Figure 6:
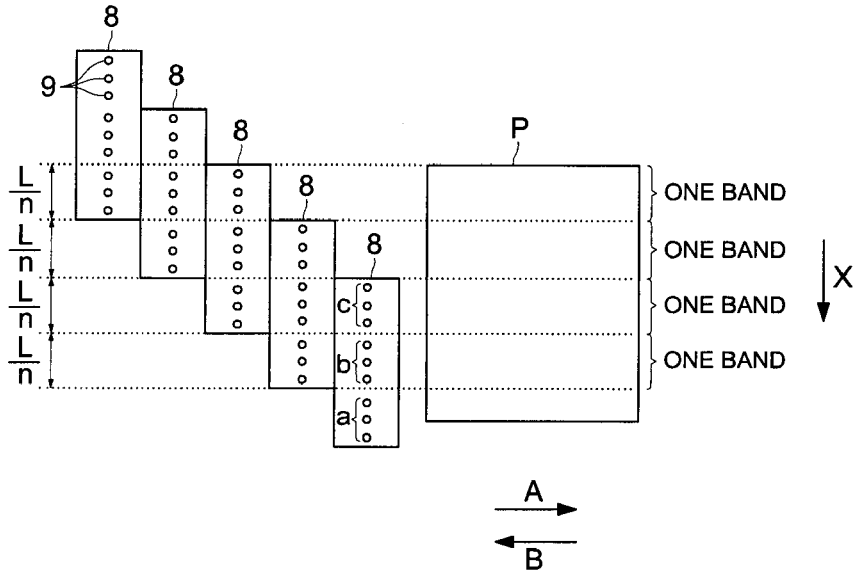
FIG. 6 is an explanatory diagram illustrating corresponding portions of a recording head when forming an image for one band in an embodiment of the present invention.

As shown in FIG. 5, the inkjet recording apparatus 1 is provided with a control 16 for controlling each unit of the apparatus. The control 16 includes, for example, a CPU (central processing unit), a ROM (read only memory) for storing various processing programs and others, a RAM (random access memory) for temporarily storing various data such as image data and the like (none of them shown). The control 16 transfers the processing programs stored in the ROM to the work area of the RAM to allow the CPU to execute the processing programs.

The inkjet recording apparatus 1 also has an input 17 for inputting the type of the recording medium P, image recording conditions and others, and information inputted from the input 17 is sent to the control 16. The input 17 is, for example, a keyboard or control panel, and a user can operate the input 17 to select or set various recording modes or the number of scans n, based on the recording medium P used for the image recording, desired image recording rate or resolution or the like.

When the number of scans n is not specified by an operator, the control 16 determines the number of scans n based on the inputted conditions and amount of image data information. The control 16 also controls the ultraviolet irradiation device 10 based on the number of scans n such that the length along the feeding direction of the shield 13 is adjusted to be equal to L/n by the shield adjustment mechanism 14.

In addition, the control 16 controls the moving unit 7 to reciprocally scan the carriage 6 in the main scanning directions A, B, and also controls the feeding unit 3 to intermittently feed the recording medium P in the feeding direction X by a predetermined amount at a time when the moving direction of the carriage 6 is switched. Here, the predetermined amount fed by the feeding unit 3 is expressed as L/n.

Further, the control 16 controls the recording head 8 to eject ink by such an amount as to form one band during n scans based on the image data of a recorded image sent from an external device (not shown), recording mode inputted at the input 17 and others. Here, the control 16 divides the ink ejection openings 9 into n groups and causes each group of the ink ejection openings 9 to eject ink to the respective band at every scan.

Furthermore, the control 16 controls the ultraviolet irradiation device 10 to irradiate the ink ejected to the recording medium P with ultraviolet light. Here, the portion of the ultraviolet irradiation device 10 facing the ink ejected at the nth scan is completely shielded by the shield 13 and reflectors 15, thus allowing shielded and unshielded portions to coexist in a single ultraviolet irradiation device 10. Therefore, controlling the lighting of a single ultraviolet irradiation device 10 can irradiate the ink ejected at the first to (n−1)th scans and at the (n+1)th and subsequent scans with ultraviolet light.

An inkjet recording method according to the embodiment will be now described. The description below will be made for the case where ink needed for forming one band is ejected during three scans and the image recording of the band is completed at the fourth scan.

When an image data inputted from an external device (not shown) is sent to the inkjet recording apparatus 1, the sent image data is stored in the RAM of the control 16. When a user then inputs a signal for starting an image recording and various image recording conditions such as the type of the recording medium P and recording mode, the control 16 determines that n=3 (n is the number of ink ejection scans needed for forming one band) so as to meet various conditions such as the inputted information. When the control 16 determines that n (the number of scans)=3, it starts the image recording.

First, the control 16 controls the feeding unit 3 to feed the recording medium P at a recording start position, and then starts the first scan. The control 16 controls the moving unit 7 to move the carriage 6 above the recording medium P in the forward main scanning direction A. While the recording head 8 moves following the carriage 6, the control 16 controls, based on the image data and others, the first ink ejection opening group "a" positioned at one end of the recording head 8 to eject a predetermined ink drop and cause it to land on the recording medium P. The control 16 further controls, immediately after the landing of the ink, the ultraviolet irradiation device 10 to radiate ultraviolet light to cure the ink, thereby recording the image for the first scan.

When the first scan is completed, the control 16 again feeds the recording medium P downstream in the feeding direction X by L/n and starts the second scan. Predetermined ink is ejected from the second ink ejection group "b" positioned approximately at the middle of the head while the recording head 8 is being moved in the backward main scanning direction B, and immediately thereafter the ink is cured by the ultraviolet irradiation device 10, thereby recording the image for the second scan.

The control 16 further controls the feeding unit 3 to feed the recording medium P by L/n and starts the third scan. While the recording head 8 is being again moved in the forward main scanning direction A, ink is ejected from the third ink group "c" positioned at the other end of the head, and the third scan is completed.

Thereafter, the control 16 controls the feeding unit 3 to feed the recording medium P by L/n and starts the fourth scan. The ultraviolet irradiation device 10 is moved by moving the carriage 6 in the backward main scanning direction B to irradiate the ink ejected at the third scan with ultraviolet light and cure it. Thus, the forth scan completes the image recording for the top band of the recording medium P.

Although, this embodiment has been described for the case where the number of ink ejection scans n for recording one band is 3, the number of scans n is not particularly limited, but ink may be ejected during, for example, six scans to form one band. In this case, the ink ejected at the 6th scan is irradiated with ultraviolet light and cured at the 7th scan. That is, ink needed for forming one band is ejected during n scans and the image recording for the band is completed at the (n+1)th and subsequent scans.

As described above, according to this embodiment, an ink drop ejected at the nth scan can be irradiated with ultraviolet light at a timing corresponding to the (n+1)th and subsequent scans. Therefore, sufficient time can be secured after the landing of the ink until the irradiation with ultraviolet light so that the diameter of dots has sufficiently expanded and become uniform irrespective of the scan direction before the ultraviolet light is radiated. This prevents difference in dot diameter between in the forward moving direction A and backward moving direction B of the carriage 6 at the nth scan. As a result, difference in hue, gloss or the like of the recorded image for one band between the main scanning directions is less likely to occur, thus enabling high resolution image recording.

Figure 7:
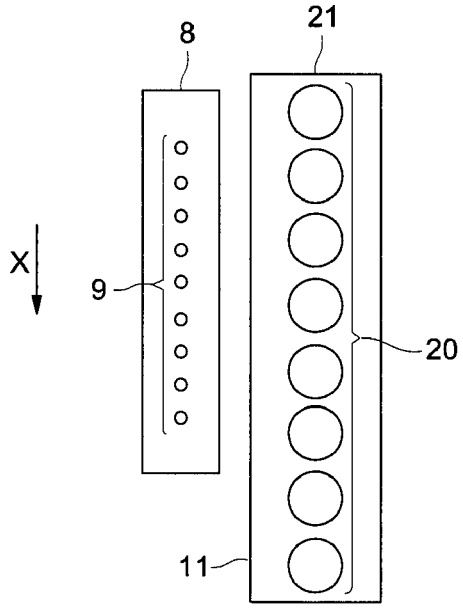
FIG. 7 is a bottom view of a recording head and ultraviolet irradiation device according to an alternative embodiment of the present invention.

Although, in this embodiment, the ultraviolet irradiation device 10 is provided with the shield 13 in the portion facing the ink ejected at the nth scan to shield light, the ultraviolet light source may be configured with multiple light source unit 20 each of whose lighting is independently controllable as shown in FIG. 7. Here, an example of the light source unit 20 includes point light sources such as semiconductor lasers or LEDs (Light Emitting Diodes).

Figure 8:
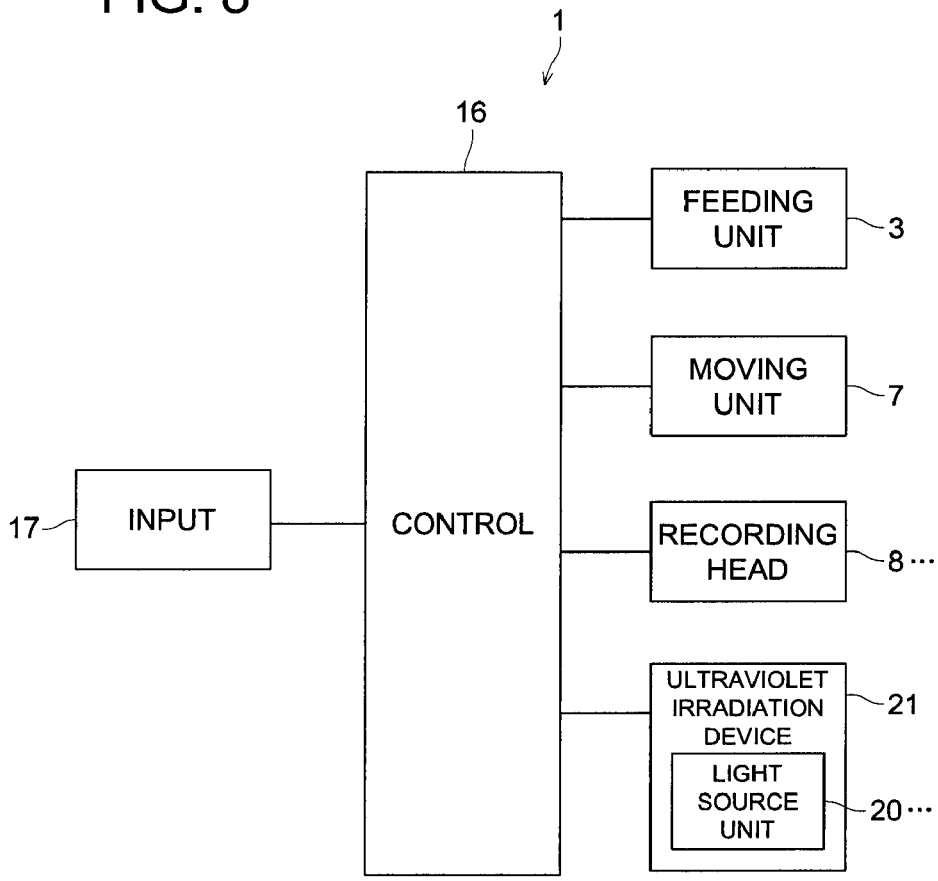
FIG. 8 is a block diagram illustrating a control configuration of an inkjet recording apparatus according to an alternative embodiment of the present invention.
Figure 9:
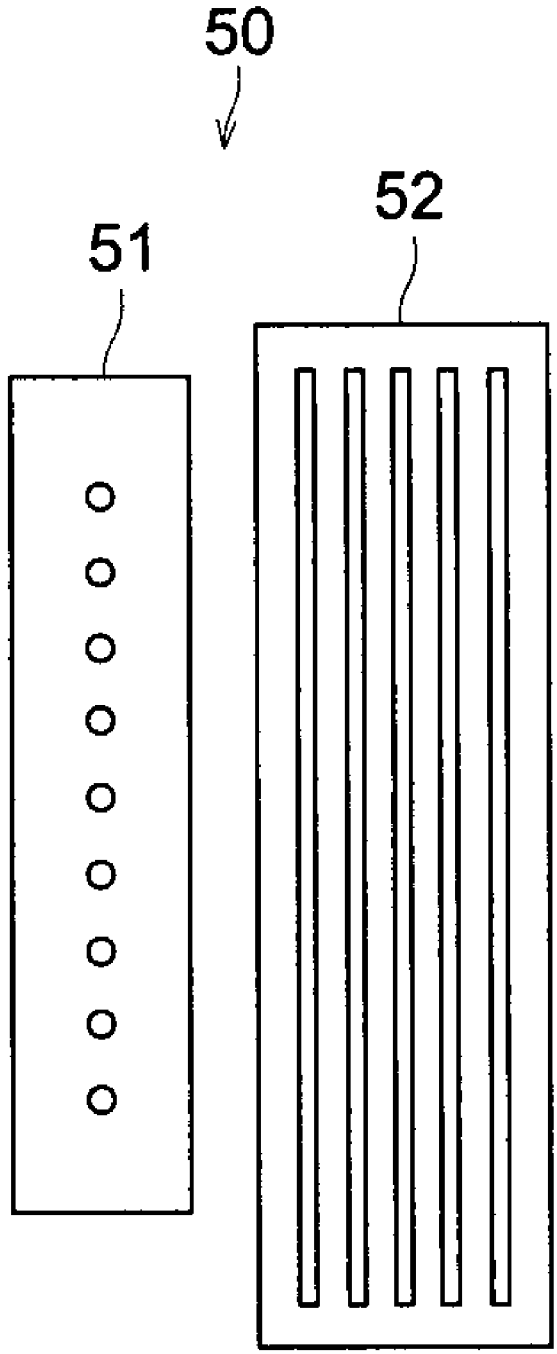
FIG. 9 is a bottom view of a recording head and ultraviolet irradiation device of a conventional inkjet recording apparatus.

As shown in FIG. 8, the light source unit 20 is provided in an ultraviolet irradiation device 21 and a control 16 can control each light source unit 20 to be turned on and off independently. Therefore, when the number of scans n is determined, the control 16 turns off the light source unit 20 facing the region on which the ink ejected at the nth scan lands.

Such a control configuration can reduce the amount of light incident on the ink ejected at the nth scan, which secures sufficient time for curing the ink, thus obtaining the effect of the present invention without providing any additional shield.

In addition, although in this embodiment an image is recorded using an ink cured by irradiation with ultraviolet light, the ink is not necessarily limited to this type but may be cured by irradiation with, for example, light other than ultraviolet light such as ultraviolet light, electron beam, X-ray, visible light, or infrared light. In this case, the ink contains: a polymerizable compound polymerized and cured by light other than ultraviolet light; and a photoinitiator for initiating polymerization between polymerizable compounds under light other than ultraviolet light. In addition, when using a photo curable ink cured by light other than ultraviolet light, a light source radiating such light instead of ultraviolet light is used.

Further, the recording head 8 used in the inkjet recording apparatus 1 according to the invention may be of an on-demand or continuous system. Any of, for example, the following methods can be used as the ink jet method for the present invention: electro-mechanical conversion methods (such as a single-cavity type, double-cavity type, vendor type, piston type, share-mode type, or shared wall type); electrical-thermal conversion methods (such as a thermal ink-jet type, or Bubble Jet type (registered trademark)); electrostatic attraction methods (such as an electric field control type or slit jet type); and electrical discharge methods (such as a spark jet type).

The present invention includes the following configurations.

Configuration 1:

An inkjet recording apparatus of Configuration 1 includes: a recording head having an ink ejection opening for ejecting a photo curable ink cured by irradiation with light onto a recording medium, the ink ejection opening being formed along a feeding direction of the recording medium; a light irradiation device including a light source for irradiating the ejected ink with light; moving unit for reciprocally moving the recording head and light irradiation device in a main scanning direction; feeding unit for intermittently feeding the recording medium in the feeding direction by a predetermined amount at a time; and a control for ejecting ink needed for forming one band by reciprocally scanning the recording head n times to record an image, in which each irradiation of the ink ejected at the first to (n−1)th scans is performed at the respective scan while the irradiation of the ink ejected at the nth scan is performed at the (n+1)th and subsequent scans.

In the Configuration 1 above, a photo-curable ink cured by irradiation with light is ejected from the recording head onto the recording medium while the recording head is being reciprocally scanned in the main scanning direction and then the ejected ink is irradiated with light to record an image. Here, ink needed for forming one band is ejected by scanning the recording head n times, and the ink ejected at the first to (n−1)th scans is each irradiated with light at the respective scan, while the ink ejected at the nth scan is irradiated with light not at the nth scan but at the (n+1)th and subsequent scans.

According to the Configuration 1, the ink ejected at the nth scan, which is the last scan of each band, is irradiated with light at a timing corresponding to the (n+1)th and subsequent scans; thus, sufficient time has elapsed after the ink ejected at the nth scan has landed on the recording medium until it is irradiated with light. As a result, the diameter of dots has sufficiently expanded and become uniform (including a state in which adjacent dots join) irrespective of the scan direction before they are irradiated with light, which prevents difference in hue or gloss caused by dot diameter difference between scans, thus offering high-resolution image recording.

In general, a diameter difference of dots ejected at the last scan for each band has the most significant effect on the quality of the recorded image when observed with bare eyes. This configuration secures sufficient time after the ink ejected at the nth scan has landed on the recording medium until it is irradiated with light, so that the ink is irradiated with light and cured after the diameter of the dots has become uniform irrespective of the scan direction. Therefore, degradation of image quality caused by dot diameter difference can be prevented, thus ensuring high-resolution image recording.

Configuration 2:

An inkjet recording device of Configuration 2 is according to Configuration 1, and characterized in that the light irradiation device is formed having a length of L×(1+1/n) or more along the feeding direction where L represents the length of the column of the ink ejection openings, and includes a shield for shielding at least a portion of wavelengths of light in a portion facing the ink ejected at the nth scan.

In Configuration 2, the light irradiation device is formed having a length of L×(1+1/n) or more along the feeding direction where L represents the length of the column of the ink ejection openings, and includes a shield for shielding at least a portion of wavelengths of light in a portion facing the ink ejected at the nth scan. Therefore, use of such a light irradiation device can shield the light radiated from the portion thereof facing the ink ejected at the nth scan.

According to Configuration 2, a single light irradiation device can shield only the portion facing the ink ejected at the nth scan while not shielding portions facing the ink ejected at the first to (n−1)th scans and at the (n+1)th and subsequent scans to allow light irradiation. Thus, shielded and unshielded portions can coexist in a single light irradiation device, thereby allowing high-resolution image recording using a simpler configuration.

Configuration 3:

An inkjet recording apparatus of Configuration 3 is according to Configuration 2, and characterized in that the light irradiation device shields light of ultraviolet wavelengths.

In Configuration 3, the shield shields light of ultraviolet wavelengths.

According to Configuration 3, the shield shields light of ultraviolet wavelengths while transmitting light of the other wavelengths, so that the ink ejected at the nth scan is supplied with thermal energy immediately after the landing of the ink, thereby allowing the ink to be cured with low illuminance of light at the (n+1)th and subsequent scans. Thus, the ink ejected at the nth scan is prevented from being irradiated with ultraviolet light and cured at the nth scan, but is ensured to be cured at the (n+1)th and subsequent scans after sufficient time has been secured for the diameter of dots to become uniform irrespective of the scan direction, thus providing higher resolution image recording.

Configuration 4:

An inkjet recording device of Configuration 4 is according to Configuration 2 or 3, and characterized in that reflectors are provided each at the front and rear ends of the shield 13 in the feeding direction X such that the reflectors do not face each other and approximately perpendicular to the recording medium.

In Configuration 4, reflectors are provided each at the front and rear ends of the shield in the feeding direction X such that the reflectors do not face each other and approximately perpendicular to the recording medium. Therefore, light from outside the shield is reflected by the reflectors, thus preventing a region of the recording medium facing the shield from being irradiated.

According to Configuration 4, the ink landing on the region facing the shield cannot be irradiated with light, preventing the ink ejected at the nth scan from being irradiated with light and cured. Thus, the shied and reflectors ensure to shield light incident on the ink ejected at the nth scan, which secures sufficient time for the diameter of the dots to expand and become uniform irrespective of the scan direction, thus providing higher resolution image recording.

Configuration 5:

An inkjet recording apparatus of Configuration 5 is according to any one of Configurations 2 to 4, and characterized in that the length of the shield in the feeding direction is adjustable.

In Configuration 5, since the length of the shield in the feeding direction is adjustable, the shielded portion can be varied.

According to Configuration 5, since the shielded portion can be varied, the number of scans is adjustable based on conditions such as the light irradiation device, recording medium and ink used in the recording, or recording mode. Thus, an optimum number of scans n can be chosen based on image recording conditions, thereby enabling higher resolution image recording.

Configuration 6:

An inkjet recording apparatus of Configuration 6 is according to Configuration 1, and characterized in that the light irradiation device is formed having a length of L×(1+1/n) or more along the feeding direction where L represents the length of the column of the ink ejection openings of the recording head and configured with multiple light source unit each of whose lighting is independently controllable, while the control turns off the light source unit facing the region on which the ink ejected at the nth scan lands.

In Configuration 6, the light irradiation device is formed having a length of L×(1+1/n) or more along the feeding direction where L represents the length of the column of the ink ejection openings of the recording head and configured with multiple light source unit each of whose lighting is independently controllable. Further, the control turns off the light source unit facing the ink ejected at the nth scan.

According to Configuration 6, each of the multiple light source unit included in the light irradiation device can be independently turned on and off, allowing the region irradiated with light to be adjusted using an efficient and simple configuration. Thus, turning off only the light source unit facing the ink ejected at the nth scan can provide high resolution image printing using an efficient and simple configuration.

Configuration 7:

An inkjet recording apparatus of Configuration 7 is according to Configuration 6, and characterized in that the control change the number of scans n based on image recording conditions, and turns off the light source unit according to the change.

In Configuration 7, the control changes the number of scans n based on image recording conditions, and turns off the light source unit according to the change.

According to Configuration 7, the number of scans n not only can be changed based on image recording conditions, but also, even when the n is changed, the region irradiated with light can be adjusted only by controlling the on and off of each light source unit. Thus, the region irradiated with light can be adjusted using a simple configuration, thereby realizing high resolution image recording.

Configuration 8:

An inkjet recording apparatus of Configuration 8 is according to any one of Configurations 1 to 7, and characterized in that the control controls the light irradiation device such that the amount of light radiated at the (n+1)th and subsequent scans is larger than that at the first to (n−1)th scans.

In Configuration 8, the light irradiation device radiates a larger amount of light at the (n+1)th and subsequent scans than that at the first to (n−1)th scans.

According to Configuration 8, the amount of light radiated at the (n+1)th and subsequent scans is larger than that at the first to (n−1)th scans, so that the ink ejected at the nth scan is ensured to be cured at the (n+1)th and subsequent scans. Thus, all the ink ejected for recording an image for one band can be cured at the (n+1)th and subsequent scans, so that ink bleeding or the like can be prevented, thereby providing higher resolution image recording.

Method A:

An inkjet recording method of Method A includes the steps of: ejecting a photo curable ink cured by irradiation with light onto a recording medium from a recording head while reciprocally scanning the recording head in a main scanning direction; and recording an image by irradiating the ejected ink with light, in which, when ejecting ink needed for forming one band by reciprocally scanning the recording head n times, each irradiation of the ink ejected at the first to (n−1)th scans is performed at the respective scan while the irradiation of the ink ejected at the nth scan is performed at the (n+1)th and subsequent scans.

In Method A, a photo curable ink cured by irradiation with light is ejected onto the recording medium from the recording head while the recording head is being reciprocally scanned in the main scanning direction, and an image is recorded by irradiating the ejected ink with light. Here, the ink needed for forming one band is ejected by reciprocally scanning the recording head n times, and the ink ejected at the first to (n−1)th scans is each irradiated with light at the respective scan while the ink ejected at the nth scan is irradiated with light not at the nth scan but at the (n+1)th and subsequent scans.

According to Method A, the ink ejected at the nth scan, which is the last scan for each band, is irradiated with light at a timing corresponding to the (n+1)th and subsequent scans; thus, sufficient time has elapsed after the ink ejected at the nth scan has landed on the recording medium until it is irradiated with light. As a result, the diameter of dots has sufficiently expanded and become uniform (including a state in which adjacent dots join) irrespective of the scan direction before they are irradiated with light, which prevents difference in hue or gloss caused by dot diameter difference between scans, thus offering high-resolution image recording.

In general, a diameter difference of dots ejected at the last scan for recording each band has the most significant effect on the quality of the recorded image when observed with bare eyes. This method secures sufficient time after the ink ejected at the nth scan has landed on the recording medium until it is irradiated with light, so that the ink is irradiated with light and cured after the diameter of the dots has become uniform irrespective of the scan direction. As a result, degradation of image quality caused by dot diameter difference can be prevented, thus ensuring high-resolution image recording.

The invention claimed is:

1. An inkjet recording apparatus comprising:

a recording head having a plurality of ink ejection openings for ejecting photo-curable ink, which is cured by irradiation with light, onto a recording medium, the ink ejection openings being formed along a feeding direction of the recording medium;

a light irradiation device including a light source for irradiating the ejected ink with light;

a moving unit for reciprocally moving the recording head and the light irradiation device in a main scanning direction;

a feeding unit for intermittently feeding the recording medium in the feeding direction by a predetermined amount at a time; and a control unit for ejecting ink needed for forming one band by reciprocally scanning the recording head n times to record an image, wherein the control unit controls the light irradiation device to irradiate the ink ejected in respective scans of first to (n−1)th scans and fully cure the ink with the light at the respective scans and irradiate the ink and fully cure the ink ejected in the nth scan at one of the (n+1)th and subsequent scans.

2. The inkjet recording apparatus according to claim 1, wherein the light irradiation device is formed having a length of L×(1+1/n) or more along the feeding direction where L represents a length of a column of the ink ejection openings of the recording head, and includes a shield for shielding at least a portion of wavelengths of light in an area facing the ink ejected at the nth scan.

3. The inkjet recording apparatus according to claim 2, wherein the shield shields light of ultraviolet wavelengths.

4. The inkjet recording apparatus according to claim 2, wherein reflectors are provided each at front and rear ends of the shield in the feeding direction such that the reflectors do not face each other and approximately perpendicular to the recording medium.

5. The inkjet recording apparatus according to claim 2, wherein the length of the shield in the feeding direction is adjustable.

6. The inkjet recording apparatus according to claim 1, wherein the light irradiation device is formed having a length of L×(1+1/n) or more along the feeding direction where L represents a length of a column of the ink ejection openings of the recording head and configured with a plurality of light sources each of whose lighting is independently controllable and the control unit controls the light source that faces an area where ink has been ejected at the nth scan to turn off.

7. The inkjet recording apparatus according to claim 6, wherein the control unit changes the number of scans n based on image recording conditions, and turns off the light source according to the change.

8. The inkjet recording apparatus according to claim 1, wherein the light irradiation device radiates a larger amount of light at the (n+1)th and subsequent scans than that at the first to (n−1)th scans.

9. An inkjet recording method for recording an image, comprising:

ejecting a photo-curable ink cured by irradiation with light onto a recording medium from a recording head while reciprocally scanning the recording head in a main scanning direction; and irradiating the ejected ink with light, wherein, when ejecting ink needed for forming one band by reciprocally scanning the recording head n times, each irradiation of the ink fully cures the ink ejected at the first to (n−1)th scans and is performed at the respective scans while the irradiation of the ink ejected at the nth scan fully cures the ink and is performed at the (n+1)th or one of subsequent scans.

* * * * *